US007662273B2

(12) United States Patent
Murphy et al.

(10) Patent No.: US 7,662,273 B2
(45) Date of Patent: Feb. 16, 2010

(54) LUBE BASESTOCKS MANUFACTURING PROCESS USING IMPROVED HYDRODEWAXING CATALYSTS

(75) Inventors: William J. Murphy, Baton Rouge, LA (US); Stuart L. Soled, Pittstown, NJ (US); Ian A. Cody, Baton Rouge, LA (US); David W. Larkin, Sugar Land, TX (US); Terry E. Helton, Bethlehem, PA (US); Gary B. McVicker, Califon, NJ (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 651 days.

(21) Appl. No.: 11/205,643

(22) Filed: Aug. 17, 2005

(65) Prior Publication Data

US 2006/0086644 A1 Apr. 27, 2006

Related U.S. Application Data

(60) Provisional application No. 60/607,807, filed on Sep. 8, 2004.

(51) Int. Cl.
*C10G 47/02* (2006.01)

(52) U.S. Cl. ..... 208/135; 208/133; 208/134; 208/136; 208/137; 208/138; 502/64; 502/65; 502/66; 502/71; 502/73; 502/74; 502/77; 502/214

(58) Field of Classification Search .... 208/106–111.01, 208/28, 133–139; 502/64–66, 71, 73–74, 502/77, 214
See application file for complete search history.

(56) References Cited

U.S. PATENT DOCUMENTS

| | | | | |
|---|---|---|---|---|
| 4,399,059 | A * | 8/1983 | Chu | 502/73 |
| 5,565,086 | A * | 10/1996 | Cody et al. | 208/27 |
| 5,977,425 | A * | 11/1999 | Brandes et al. | 585/734 |
| 6,475,374 | B1 * | 11/2002 | Leta et al. | 208/62 |
| 2003/0166452 | A1 * | 9/2003 | Benazzi et al. | 502/66 |
| 2004/0097770 | A1 * | 5/2004 | Dakka et al. | 585/467 |

* cited by examiner

*Primary Examiner*—Robert J Hill, Jr.
*Assistant Examiner*—Brian McCaig
(74) *Attorney, Agent, or Firm*—Robert A. Migliorini

(57) ABSTRACT

A process for producing lube oil basestocks wherein a wax containing lube oil boiling range feedstream is converted into a basestock suitable for use in motor oil applications by contacting it with a hydrodewaxing catalyst containing a medium pore molecular sieve having deposited thereon an active metal oxide and at least one hydrogenation metal selected from the Group VIII and Group VIB metals.

36 Claims, 4 Drawing Sheets

Feed : Hydrotreated150N Slack wax

Conditions 1LHSV, 1000psig, 2500scf $H_2$/b

Feed: 150N Hydrotreated slack wax
Conditions: 1LHSV, 1000psig, 2500scf $H_2$

Minimal line-out time required for yttria doped catalyst (*Operating conditions*: *ZSM-48 catalyst temperature* = 335 °C, *LHSV* = 1 $hr^{-1}$, $H_2$ *treat gas rate* = 2500 *scf/b*, *Unit Presssure.* = 1000 *psi*, *Feed* = *HT 150 N SW*)

Significant line-out time required for ZSM-48 catalyst (Operating conditions: LHSV = 1 $hr^{-1}$, $H_2$ treat gas rate = 2500 scf/b, Unit Presssure, = 1000 psi, Feed = HT 150 N SW)

LUBE BASESTOCKS MANUFACTURING PROCESS USING IMPROVED HYDRODEWAXING CATALYSTS

CROSS REFERENCE TO RELATED APPLICATION

This application claims benefit of U.S. Provisional Patent Application Ser. No. 60/607,807 filed Sep. 8, 2004.

FIELD OF THE INVENTION

This invention relates to a process for preparing lubricating oil basestocks from lube oil boiling range feedstreams. More particularly, the present invention is directed at a process wherein a wax containing lube oil boiling range feedstream is converted into a basestock suitable for use in motor oil applications by contacting it with a hydrodewaxing catalyst containing a medium pore molecular sieve having deposited thereon an active metal oxide and at least one hydrogenation metal selected from the Group VIII and Group VIB metals.

BACKGROUND OF THE INVENTION

Until recently, improvements in the standards for passenger vehicle lubricants and commercial vehicle lubricants were achieved largely with the use of better additives, such as anti-oxidants, antiwear agents, detergents and viscosity improvers to improve specific properties of the basestocks used to prepare the finished products. In the 1990s, with the advent of increased environmental concerns, the performance requirements for the basestocks themselves have increased. The performance of the lubricating oil products themselves began a rapid change as additives alone have not been able to address the new requirements demanded by the equipment manufacturers accelerated efforts to improve automotive performance, via reduced emissions and fuel economy, etc. In North America over the past decade SAE 5W-30 oils have required basestock viscosity index ("VI") of the light basestock to increase from about 100 to 115 due to tougher ILSAC, GF-1, GF 2 and GF3 standards. VI is a convenient guide to low temperature viscosity and volatility, properties that really under pin automotive performance. This VI target is achievable only in low yields, from most crudes, by the conventional separations based, processing steps of vacuum distillation, solvent extraction and solvent dewaxing. Similar trends have occurred in Europe with ACEA requirements.

Conventional techniques for preparing basestocks such as hydrocracking or solvent extraction require severe operating conditions such as high pressure and temperature or high solvent:oil ratios and high extraction temperatures to reach these higher basestock qualities. Either alternative involves expensive operating conditions and low yields.

Further, most lubricating oil feedstocks must be dewaxed in order to produce lubricating oils which will remain fluid down to the lowest temperature of use. Dewaxing is the process of separating or converting hydrocarbons which solidify readily (i.e., waxes) in petroleum fractions. The hydrodewaxing of wax and waxy feeds boiling in the lubricating oil range and catalysts useful in such processes is well known in the art. Generally these processes utilize catalysts comprising a molecular sieve component and a component selected from the Group VIII and/or Group VIB metals.

As finished oil performance requirements increase so does the requirement for improved lube oil basestocks properties. To address this need the search for new and different processes, catalysts and catalyst systems that exhibit improved activity, selectivity and/or longevity is an ongoing exercise. Thus, there is a need in the lube oil market to provide processes that can produce lube oil basestocks that meet the demand for better performance, e.g., increased fuel economy and reduced emissions, etc.

SUMMARY OF THE INVENTION

Figure 1:
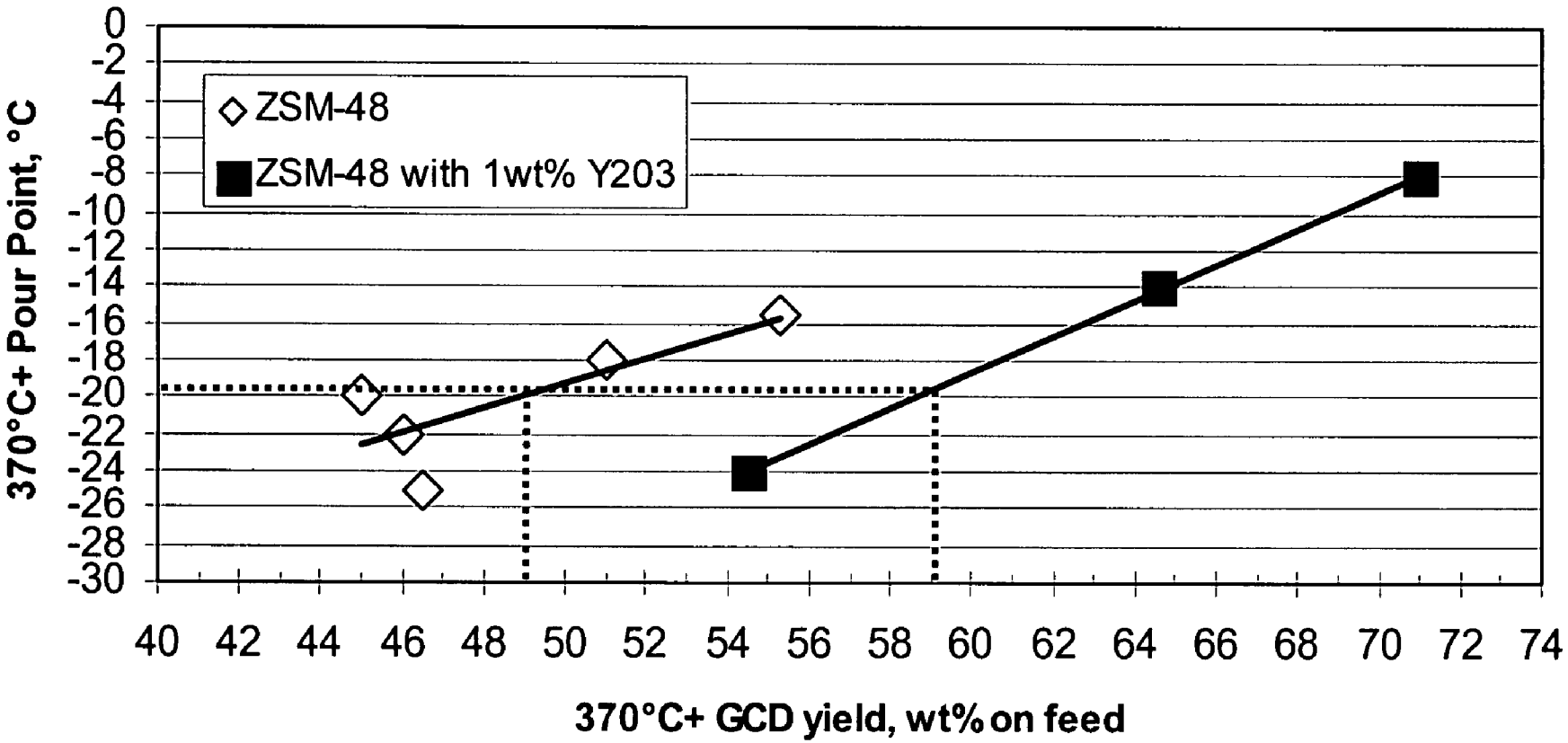
FIG. 1 is a graph relating pour point to yield of lube oil basestocks obtained by hydrodewaxing a 150N slack wax with a ZSM-48 catalyst according to the present invention compared a conventional ZSM-48 based hydrodewaxing catalyst.

The present invention is directed at a process to prepare lubricating oil basestocks. The process comprises:

a) contacting a lube oil boiling range feedstream with a hydrodewaxing catalyst in a reaction stage operated under effective hydrodewaxing conditions thereby producing a lubricating oil basestock, wherein said hydrodewaxing catalyst comprises:
   i) at least one medium pore molecular sieve;
   ii) at least one active metal oxide selected from the rare earth metal oxides; and
   iii) at least one hydrogenation metal selected from the Group VIII and Group VIB metals.

In one embodiment of the instant invention, the at least one active metal oxide of the hydrodewaxing catalyst is selected from the Group IIIB rare earth metal oxides.

In yet another embodiment, the rare earth metal oxide is yttria.

In still another embodiment, the at least one hydrogenation metal selected from the Group VIII and Group VIB metals of the hydrodewaxing catalyst is selected from the Group VIII noble metals.

In still another embodiment, the at least one hydrogenation metal selected from the Group VIII and Group VIB metals of the hydrodewaxing catalyst is selected from Pt, Pd, and mixtures thereof.

DETAILED DESCRIPTION OF THE INVENTION

The present process involves contacting a lubricating oil feedstream with a hydrodewaxing catalyst in a reaction stage operated under effective hydrodewaxing conditions to produce a dewaxed lubricating oil basestock. The hydrodewaxing catalyst comprises at least one medium pore molecular sieve, at least one active metal oxide selected from the rare earth metal oxides, and at least one hydrogenation metal selected from the Group VIII and Group VIB metals.

Lubricating Oil Feedstreams

Feedstreams suitable for use in the present invention are wax-containing feeds that boil in the lubricating oil range, typically having a 10% distillation point greater than 650° F. (343° C.), measured by ASTM D 86 or ASTM 2887, and are derived from mineral sources, synthetic sources, or a mixture of the two. Non-limiting examples of suitable lubricating oil feedstreams include those derived from sources such as oils derived from solvent refining processes such as raffinates, partially solvent dewaxed oils, deasphalted oils, distillates, vacuum gas oils, coker gas oils, slack waxes, foots oils and the like, dewaxed oils, automatic transmission fluid feedstocks, and Fischer-Tropsch waxes. Preferred lubricating oil feedstocks are those selected from raffinates, automatic transmission fluid feedstocks, and dewaxed oils.

These feedstreams may also have high contents of nitrogen- and sulfur-contaminants. Feeds containing up to 0.2 wt. % of nitrogen, based on feed and up to 3.0 wt. % of sulfur can be processed in the present process. Feedsteams having a high wax content typically have high viscosity indexes of up to 200 or more. Sulfur and nitrogen contents may be measured by standard ASTM methods D5453 and D4629, respectively.

Hydrotreating

In one embodiment, it is preferred that the lube oil boiling range feedstream is hydrotreated under effective hydrotreating conditions prior to contacting the dewaxing catalyst. Effective hydrotreating conditions as used herein are to be considered those hydrotreating conditions effective at removing at least a portion of the sulfur contaminants present in the lube oil boiling range feedstream thus producing at least a hydrotreated lube oil boiling range feedstream. Typical effective hydrotreating conditions will include temperatures range from about 100° C. to about 400° C. with pressures from about 50 psig (446 kPa) to about 3000 psig (20786 kPa), preferably from about 50 psig (446 kPa) to about 2500 psig (17338 kPa). However, the effective hydrotreating conditions and catalysts are not critical to the present invention and any hydrotreating conditions effective at removing at least a portion of the sulfur from the lube oil boiling range feedstream can be used. Also, any hydrotreating catalyst can be used. It should be noted that the term "hydrotreating" as used herein refers to processes wherein a hydrogen-containing treat gas is used in the presence of a suitable catalyst that is primarily active for the removal of heteroatoms, such as sulfur, and nitrogen. Suitable hydrotreating catalysts for use in the present invention are any conventional hydrotreating catalyst and includes those which are comprised of at least one Group VIII metal, preferably Fe, Co and Ni, more preferably Co and/or Ni, and most preferably Co; and at least one Group VI metal, preferably Mo and W, more preferably Mo, on a high surface area support material, preferably alumina. It is within the scope of the present invention that more than one type of hydrotreating catalyst be used in the same reaction vessel. The Group VIII metal is typically present in an amount ranging from about 2 to 20 wt. %, preferably from about 4 to 12%. The Group VI metal will typically be present in an amount ranging from about 5 to 50 wt. %, preferably from about 10 to 40 wt. %, and more preferably from about 20 to 30 wt. %. By "on support" we mean that the percents are based on the weight of the support. For example, if the support were to weigh 100 grams then 20 wt. % Group VIII metal would mean that 20 grams of Group VIII metal was on the support. In this embodiment, the hydrotreating of the lube oil boiling range feedstream occurs in a hydrotreating reaction stage operated under effective hydrotreating conditions, as described above. The contacting of the lube oil boiling range feedstream in the hydrotreating reaction stage with a hydrotreating catalyst, as described above, produces at least a hydrotreated product comprising a gaseous reaction product and a liquid reaction product comprises a hydrotreated lube oil boiling range feedstream. The entire hydrotreated product can be conducted to the hydrodewaxing stage described below. However, it is preferred that the hydrotreated product be separated into the gaseous reaction product and liquid reaction product comprising a hydrotreated lube oil boiling range feedstream. The method of separation is not critical to the instant invention and can be carried out by, for example, stripping, knock-out drums, etc., preferably stripping. The hydrotreated lube oil boiling range feedstream is then contacted with a hydrodewaxing catalyst, as described below, in a hydrodewaxing reaction stage.

The hydrotreating reaction stage, can be comprised of one or more fixed bed reactors or reaction zones each of which can comprise one or more catalyst beds of the same hydrotreating catalyst. Although other types of catalyst beds can be used, fixed beds are preferred. Such other types of catalyst beds include fluidized beds, ebullating beds, slurry beds, and moving beds. Interstage cooling or heating between reactors or reaction zones, or between catalyst beds in the same reactor or reaction zone, can be employed since the desulfurization reaction is generally exothermic. A portion of the heat generated during hydrotreating can be recovered. Where this heat recovery option is not available, conventional cooling may be performed through cooling utilities such as cooling water or air, or through use of a hydrogen quench stream. In this manner, optimum reaction temperatures can be more easily maintained.

Hydrodewaxing Catalyst

As stated above, the hydrodewaxing catalyst used in the present invention comprises at least one medium pore molecular sieve. Medium pore molecular sieves suitable for use in the dewaxing catalysts utilized in the present invention can be selected from acidic metallosilicates, such as silicoaluminophophates (SAPOs), and unidimensional 10-ring zeolites, i.e., medium pore zeolites having unidimensional channels comprising 10-member rings. It is preferred that the molecular sieve be a zeolite.

The silicoaluminophophates (SAPOs) useful as the at least one molecular sieve can be any of the SAPOs known. Preferred SAPOs include SAPO-11, SAPO-34, and SAPO-41.

The medium pore zeolites, sometimes referred to as unidimensional 10-ring zeolites, suitable for use in the dewaxing catalyst employed herein can be any of those known. Medium pore zeolites as used herein can be any zeolite described as a medium pore zeolite in *Atlas of Zeolite Structure Types*, W. M. Maier and D. H. Olson, Butterworths. Zeolites are porous crystalline materials and medium pore zeolites are generally defined as those having a pore size of about 5 to about 7 Angstroms, such that the zeolite freely sorbs molecules such as n-hexane, 3-methylpentane, benzene and p-xylene. Another common classification used for medium pore zeolites involves the Constraint Index test which is described in U.S. Pat. No. 4,016,218, which is hereby incorporated by reference. Medium pore zeolites typically have a Constraint Index of about 1 to about 12, based on the zeolite alone without modifiers and prior to treatment to adjust the diffusivity of the catalyst. Preferred unidimensional 10-ring zeolites are ZSM-22, ZSM-23, ZSM-35, ZSM-57, ZSM-48, and ferrierite. More preferred are ZSM-22, ZSM-23, ZSM-35, ZSM-48, and ZSM-57. The most preferred is ZSM-48. The most preferred synthesis route to ZSM-48 is that described in U.S. Pat. No. 5,075,269.

The medium pore molecular sieve is preferably combined with a suitable porous binder or matrix material. Non-limiting examples of such materials include active and inactive materials such as clays, silica, and/or metal oxides such as alumina. Non-limiting examples of naturally occurring clays that can be composited include clays from the montmorillonite and kaolin families including the subbentonites, and the kaolins commonly known as Dixie, McNamee, Georgia, and Florida clays. Others in which the main mineral constituent is halloysite, kaolinite, dickite, nacrite, or anauxite may also be used. The clays can be used in the raw state as originally mixed or subjected to calcination, acid treatment, or chemical modification prior to being combined with the at least one molecular sieve. It is preferred that the porous matrix or binder material comprises at least one of silica, alumina, or a kaolin clay. It is more preferred that the binder material comprise alumina. The amount of molecular sieve in the dewaxing catalyst is from 10 to 100 wt. %, preferably 35 to 100 wt. %, based on catalyst. Such catalysts can be formed by methods such spray drying, extrusion and the like. The dewaxing catalyst may be used in the sulfided or unsulfided form, and is preferably in the sulfided form.

The hydrodewaxing catalyst used in the present invention also comprises at least one active metal oxide selected from the rare earth metal oxides. As used herein, "rare earth metal oxides" is meant to refer to those metal oxides comprising those elements of the periodic table having atomic numbers between 57 and 71 and yttrium, which has an atomic number of 39 but behaves similar to the rare earth metals in many applications. It is preferred that the at least one active metal oxide be selected from those rare earth metal oxides of Group IIIB of the periodic table including yttrium, more preferably the at least one active metal oxide is yttria.

The at least one active metal oxide can be incorporated onto the above-described medium pore molecular sieve by any means known to be effective at doing so. Non-limiting examples of suitable incorporation means include incipient wetness, ion exchange, mechanical mixing of metal oxide precursor(s) with molecular sieve and binder, or a combination thereof, with the incipient wetness technique being the preferred method.

The amount of active metal oxide incorporated, i.e., deposited, onto the medium pore molecular sieve is greater than 0.1 wt. %, based on the catalyst. Preferably the amount of mixed metal oxide ranges from about 0.1 wt. % to about 10 wt. %, more preferably from about 0.5 wt. % to about 8 wt. %, most preferably from about 1 wt. % to about 4 wt. %.

Hydrodewaxing catalysts suitable for use in the present invention also include at least one hydrogenation metal selected from the Group VIII and Group VIB metals. Thus, hydrodewaxing catalysts suitable for use in the present invention are bifunctional. The at least one hydrogenation metal selected from the Group VIII and Group VIB metals functions as a metal hydrogenation component. Preferred Group VIII metals are those selected from the Group VIII noble metals, more preferably selected from Pt, Pd and mixtures thereof with Pt representing the most preferred Group VIII metal. Preferred Group VIB metals include Molybdenum and Tungsten. In a particularly preferred embodiment, the at least one hydrogenation metal is selected from the Group VIII metals with preferred, etc. Group VIII metals being those described above.

The at least one hydrogenation metal is incorporated, i.e. deposited, onto the medium pore molecular sieve before or after, preferably after the at least one active metal oxide has been deposited thereon. The at least one hydrogenation metal can also be incorporated onto the above-described active metal oxide-containing medium pore molecular sieve by any means known to be effective at doing so. Non-limiting examples of suitable incorporation means include incipient wetness, ion exchange, mechanical mixing of metal oxide precursor(s) with molecular sieve and binder, or a combination thereof, with the incipient wetness technique being the preferred method.

The amount of the at least one hydrogenation metal incorporated, i.e. deposited, onto the metal oxide-containing medium pore molecular sieve is between about 0.1 to about 30 wt. %, based on catalyst. Preferably the amount of the at least one hydrogenation metal ranges from about 0.2 wt. % to about 25 wt. %, more preferably from about 0.5 wt. % to about 20 wt. %, most preferably from about 0.6 to about 20 wt. %.

Hydrodewaxing

In one embodiment of the present invention, a lube oil boiling range feedstream is contacted with the above-described hydrodewaxing catalyst in a reaction stage under effective hydrodewaxing conditions. The reaction stage containing the hydrodewaxing catalyst used in the present invention can be comprised of one or more fixed bed reactors or reaction zones each of which can comprise one or more catalyst beds of the same or different catalyst. Although other types of catalyst beds can be used, fixed beds are preferred. Such other types of catalyst beds include fluidized beds, ebullating beds, slurry beds, and moving beds. Interstage cooling or heating between reactors, reaction zones, or between catalyst beds in the same reactor, can be employed. A portion of any heat generated can also be recovered. Where this heat recovery option is not available, conventional cooling may be performed through cooling utilities such as cooling water or air, or through use of a hydrogen quench stream. In this manner, optimum reaction temperatures can be more easily maintained. It should be noted that if the hydrotreating option described above is employed, the reaction stage containing the dewaxing catalyst is sometimes referred to as the second reaction stage.

Effective hydrodewaxing conditions as used herein includes temperatures of from 250° C. to 400° C., preferably 275° C. to 350° C., pressures of from 791 to 20786 kPa (100 to 3000 psig), preferably 1480 to 17338 kPa (200 to 2500 psig), liquid hourly space velocities of from 0.1 to 10 $hr^{-1}$, preferably 0.1 to 5 $hr^{-1}$ and hydrogen treat gas rates from 45 to 1780 $m^3/m^3$ (250 to 10000 scf/B), preferably 89 to 890 $m^3/m^3$ (500 to 5000 scf/B).

The inventors hereof have found that the present invention employing hydrodewaxing catalysts as described above provides improved yields and lube oil boiling range products having better viscosity indexes ("VI") when compared to currently available commercial dewaxing processes. The increase in yields, sometimes referred to as yield credits, are on the order of 10%, based on the feed, and the VI increase, sometimes referred to as VI credits, are on the order of about 1-5 VI points.

The above description is directed to preferred embodiments of the present invention. Those skilled in the art will recognize that other embodiments that are equally effective could be devised for carrying out the spirit of this invention.

The following examples will illustrate the improved effectiveness of the present invention, but is not meant to limit the present invention in any fashion.

EXAMPLES

Example 1

Catalyst Preparation

Comparative Catalyst—Catalyst A

A base case catalyst for comparison was prepared by extruding 65 parts of ZSM-48 crystal (Si/Al2~200/1) with 35 parts of pseudoboehmite alumina. After extrusion, the extrudate was dried at 121° C. in air, followed by calcination in nitrogen at 538° C. to decompose the organic template in the zeolite. After decomposition, the extrudate was exchanged with 1 N NH4NO3 nitrate to remove sodium, followed by an additional drying step at 121° C. After the second drying step, the catalyst was calcined in air at 538° C. to convert the NH4-form of the ZSM-48 to the H-form and to remove any residual carbon remaining on the catalyst after nitrogen decomposition. The H-form of the extrudate was then impregnated with 0.6 wt. % Pt by incipient wetness impregnation using platinum tetraammine nitrate and water. After impregnation, the catalyst is dried again at 121° C. to remove excess water, followed by a mild air calcination at 360° C. to decompose the metal salt to platinum oxide.

Catalyst Suitable for Use in the Present Invention—Catalyst B

A 1 wt. % yttrium containing ZSM-48 catalyst was prepared in similar fashion to the base case catalyst described above, but prior to the platinum tetraammine nitrate impregnation, the H-form of the extrudate was impregnated with yttrium nitrate (1 wt. % yttrium) using the incipient wetness technique. The ytrrium containing catalyst was then calcined in flowing air at 538° C. to decompose the yttrium nitrate to yttrium oxide. After calcination, the yttrium containing ZSM-48 extrudate was impregnated with 0.6 wt. % Pt by incipient wetness impregnation using platinum tetraammine nitrate and water. After Pt impregnation, the resulting catalyst was dried again at 121° C. to remove excess water, followed by mild air calcination at 360° C. to decompose the metal salt to platinum oxide.

Example 2

Catalyst Use

Catalyst A and B, described in Example 1 above, were separately used to dewax a previously hydrotreated 150N slack wax having about 5 wppm sulfur, about 4 wppm nitrogen, and having a mean average boiling point of 420° C., as determined by gas chromatography. Both Catalyst A and Catalyst B were used under identical process conditions described below.

Catalyst A and B were used in two separate experiments each employing the same dewaxing conditions including temperatures of about 325° C., pressures of 1000 psig (6996 kPa), liquid hourly space velocities of 1 $hr^{-1}$, and hydrogen treat gas rates of 2500 scf/bb1 (445 $m^3/m^3$). The dewaxing of the 150N slack wax feed was carried out in a simple vertical tubular reactor, which allowed co-feeding of the hydrocarbon feeds and hydrogen. The results of these experiments are illustrated in FIGS. 1, 2, 3, and 4.

FIG. 1 illustrates that the present invention, a process utilizing Catalyst B, shows an unexpected improvement over a hydrodewaxing process employing Catalyst A. As illustrated in FIG. 1, one of the unexpected improvements of the present invention is that, at constant pour point of −20° C., under identical hydrodewaxing conditions, a hydrodewaxing process employing Catalyst A produces a 49 wt. % yield, based on the feed, while a hydrodewaxing process utilizing Catalyst B, a process according to the present invention, produces a yield of 59 wt. %, based on the feed.

Figure 2:
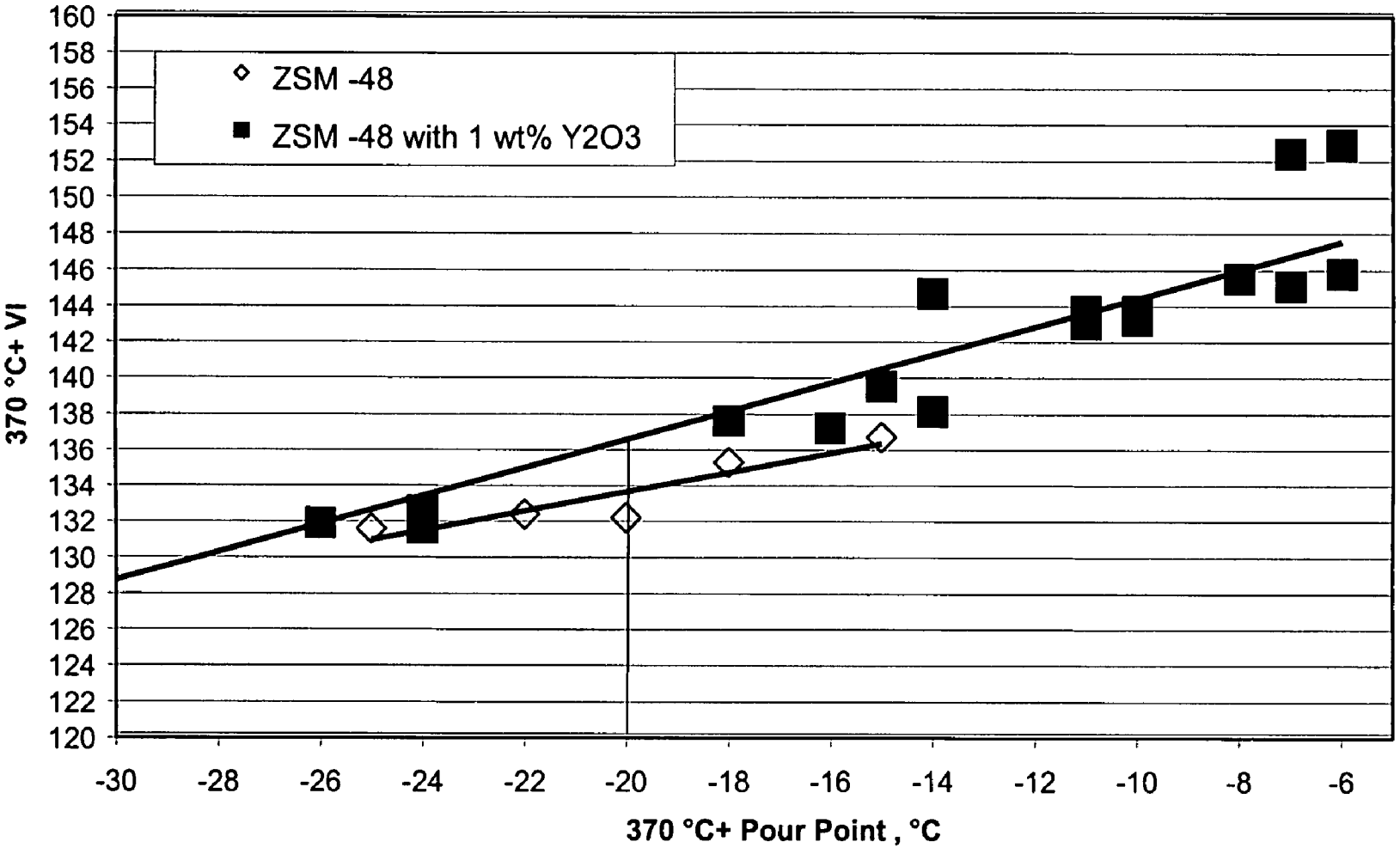
FIG. 2 is a graph comparing the pour point to viscosity index of lube oil products obtained by hydrodewaxing a 150N slack wax with a ZSM-48 catalyst according to the present invention compared to a conventional ZSM-48 based hydrodewaxing catalyst.

FIG. 2 illustrates a further unexpected improvement of the current invention. FIG. 2 illustrates that the present invention produced a product having a Viscosity Index ("VI") 2 to 5 VI points higher than the product produced by a hydrodewaxing process utilizing Catalyst A.

Figure 3:
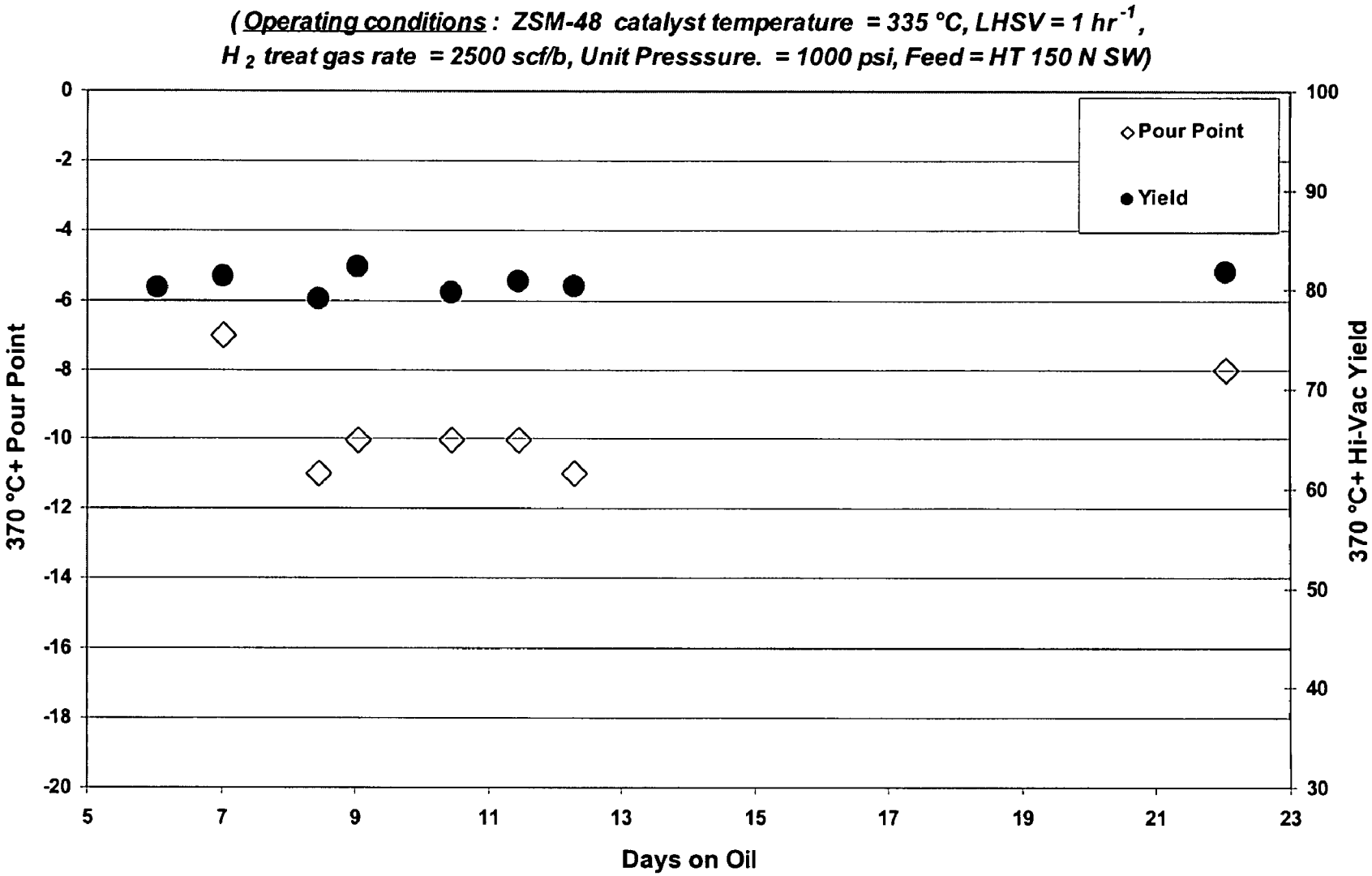
FIG. 3 is a graph relating yield to time on stream at constant pour point for the present invention.
Figure 4:
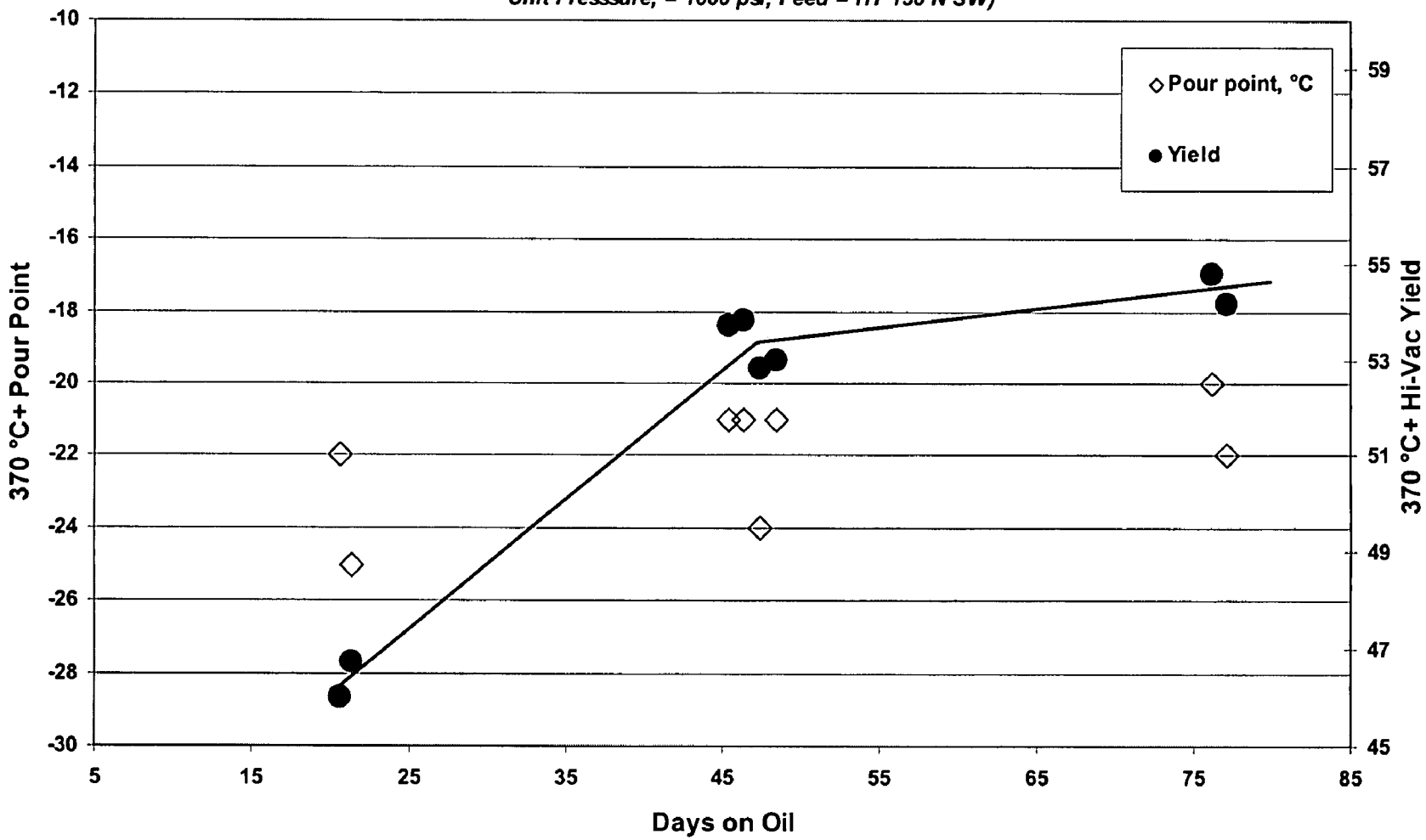
FIG. 4 is a graph relating yield to time on stream at constant pour point for a conventional ZSM-48 hydrodewaxing catalyst.

FIGS. 3 and 4, when compared, illustrate another unexpected improvement of the present invention. FIG. 3 illustrates that the present invention, a process utilizing a catalyst such as Catalyst B, lines out after less than 5 days, and the present invention exhibits yields (as defined as 370° C.+Hi-vac yields) of 82% over a period from 5 to 23 days on oil at constant pour point. FIG. 4, however, illustrates that a hydrodewaxing process using the same dewaxing conditions but utilizing Catalyst A, takes much longer to line out. As illustrated in FIG. 4, the hydrodewaxing process employing Catalyst A, even after 75+ days on oil has not reached a steady state. Further this process has not attained the high 370° C.+Hi-Vac yields of the hydrodewaxing process employing Catalyst B.

Thus, FIGS. 1, 2, 3, and 4 illustrate that the present invention provides a hydrodewaxing process having an unexpectedly rapid line out time, higher product yields and higher product VI than a process employing a conventional ZSM-48 based hydrodewaxing catalyst.

The invention claimed is:

1. A process to prepare lubricating oil basestocks comprising:

a) contacting a lube oil boiling range feedstream with a hydrodewaxing catalyst in a reaction stage operated under effective hydrodewaxing conditions thereby producing a lubricating oil basestock, wherein said hydrodewaxing catalyst comprises:

i) at least one medium pore molecular sieve;

ii) at least one active metal oxide selected from the rare earth metal oxides; and iii) at least one hydrogenation metal selected from the Group VIII and Group VIB metals;

wherein the rare earth metal oxide is incorporated onto the medium pore molecular sieve by incipient wetness wherein the medium pore molecular sieve is impregnated wit an aqueous solution of a rare earth metal salt then calcined to produce the corresponding rare earth metal oxide.

2. The process according to claim 1 wherein said lubricating oil feedstock has a 10% distillation point greater than 650° F. (343° C.), measured by ASTM D 86 or ASTM 2887, and are derived from mineral sources, synthetic sources, or a mixture of the two.

3. The process according to claim 2 wherein said lubricating oil feedstock contains up to 0.2 wt. % of nitrogen, based on the lubricating oil feedstock, and up to 3.0 wt. % of sulfur, based on the lubricating oil feedstock.

4. The process according to claim 1 wherein said medium pore molecular sieve is selected from acidic metallosilicates and zeolites.

5. The process according to claim 4 wherein said acidic metallosilicates is a silicoaluminophosphates (SAPOs).

6. The process according to claim 5 wherein said SAPO is selected from SAPO-11, SAPO-34, and SAPO-41.

7. The process according to claim 4 wherein said medium pore molecular sieve is a zeolite.

8. The process according to claim 7 wherein said zeolite is selected from ZSM-22, ZSM-23, ZSM-35, ZSM-57, ZSM-48, and ferrierite.

9. The process according to claim 7 wherein said zeolite is ZSM-48.

10. The process according to claim 9 wherein said rare earth metal oxide is yttria.

11. The process according to claim 1 wherein said medium pore molecular sieve, prior to impregnation with the aqueous rare earth metal salt solution, is composited with a suitable porous binder or matrix material selected from alumina, silica, titania, calcium oxide, strontium oxide, barium oxide, carbons, zirconia, diatomaceous earth, lanthanide oxides including cerium oxide, lanthanum oxide, neodymium oxide, yttrium oxide, and praseodymium oxide; chromia, thorium oxide, urania, niobia, tantala, tin oxide, zinc oxide, and aluminum phosphate in an amount of less than about 15 parts zeolite to one part binder.

12. The process according to claim 11 wherein said suitable porous binder or matrix material is alumina.

13. The process according to claim 1 wherein said active metal oxide is selected from the rare earth metal oxides of Group IIIB of the periodic table including yttria.

14. The process according to claim 1 wherein said at least one hydrogenation metal is deposited by incipient wetness onto the medium pore molecular sieve, the medium pore molecular sieve and binder, and any combination thereof.

15. The process according to claim 14 wherein said at least one active metal oxide is deposited onto the medium pore molecular sieve in an amount greater than 0.1 wt. %, based on the catalyst.

16. The process according to claim 14 wherein said at least one hydrogenation metal is deposited onto the medium pore molecular sieve in an amount ranging from between about 0.1 to about 30 wt. %, based on catalyst.

17. The process according to claim 1 wherein said at least one hydrogenation metal is selected from the Group VIII metals.

18. The process according to claim 17 wherein said at least one hydrogenation metal is selected from Pt, Pd and mixtures thereof.

19. The process according to claim 1 wherein said effective hydrodewaxing conditions include temperatures from 250° C. to 400° C., pressures from 791 to 20786 kPa, liquid hourly space velocities of from 0.1 to 10 $hr^{-1}$,and hydrogen treat gas rates from 45 to 1780 $m^3/m^3$.

20. A process to prepare lubricating oil basestocks comprising:

a) contacting a lube oil boiling range feedstream selected from those derived from sources such as oils derived from solvent refining processes such as raffinates, partially solvent dewaxed oils, deasphalted oils, distillates, vacuum gas oils, coker gas oils, slack waxes, foots oils and the like, dewaxed oils, automatic transmission fluid feedstocks, and Fischer-Tropsch waxes with a hydrotreating catalyst comprising at least one Group VIII metal, and at least one Group VI metal on a high surface area support material in a hydrotreating reaction stage operated under effective hydrotreating conditions and in the presence of a hydrogen-containing treat gas thereby producing at least a hydrotreated product comprising a gaseous reaction product and a liquid reaction product comprises a hydrotreated lube oil boiling range feedstream;

b) separating said hydrotreated product into said gaseous reaction product and said liquid reaction product comprising a hydrotreated lube oil boiling range feedstream;

c) contacting said hydrotreated lube oil boiling range feedstream with a hydrodewaxing catalyst in a hydrodewaxing reaction stage operated under effective hydrodewaxing conditions thereby producing a lubricating oil basestock, wherein said hydrodewaxing catalyst comprises:

i) at least one medium pore molecular sieve selected from acidic metallosilicates, and zeolites;

ii) at least one active metal oxide selected from the rare earth metal oxides; and iii) at least one hydrogenation metal selected from the Group VIII and Group VIB metals;

wherein the rare earth metal oxide is incorporated onto the medium pore molecular sieve by incipient wetness wherein the medium pore molecular sieve is impregnated with an aqueous solution of a rare earth metal salt then calcined to produce the corresponding rate earth metal oxide.

21. The process according to claim 20 wherein said lubricating oil feedatock has a 10% distillation point greater than 650° F. (343° C.), measured by ASTM D 86 or ASTM 2887, and are derived from mineral sources, synthetic sources, or a mixture of the two.

22. The process according to claim 21 wherein said lubricating oil feedstock contains up to 0.2 wt. % of nitrogen, based on the lubricating oil feedstock, and up to 3.0 wt. % of sulfur, based on the lubricating oil feedstock.

23. The process according to claim 20 wherein said acidic metallosilicates is a silicoaluminophosphates (SAPOs).

24. The process according to claim 23 wherein said SAPO is selected from SAPO-11, SAPO-34, and SAPO-41.

25. The process according to claim 20 wherein said medium pore molecular sieve is a zeolite selected from ZSM-22, ZSM-23, ZSM-35, ZSM-57, ZSM-48, and ferrierite.

26. The process according to claim 25 wherein said zeolite is ZSM-48.

27. The process according to claim 20 wherein said medium pore molecular sieve is composited, prior to impregnation with the aqueous rare earth metal salt solution, with a suitable porous binder or matrix material selected from alumina, silica, titania, calcium oxide, strontium oxide, barium oxide, carbons, zirconia, diatomaceous earth, lanthanide oxides including cerium oxide, lanthanum oxide, neodymium oxide, yttrium oxide, and praseodymium oxide; chromia, thorium oxide, urania, niobia, tantala, tin oxide, zinc oxide, and aluminum phosphate in an amount of less than about 15 parts zeolite to one part binder.

28. The process according to claim 27 wherein said suitable porous binder or matrix material is alumina.

29. The process according to claim 20 wherein said active metal oxide is selected from the rare earth metal oxides of Group IIIB of the periodic table including yttria.

30. The process according to claim 29 wherein said rare earth active metal oxide is yttria.

31. The process according to claim 20 wherein said at least one hydrogenation metal is deposited by incipient wetness onto the medium pore molecular sieve, the medium pore molecular sieve and binder, and any combination thereof.

32. The process according to claim 31 wherein said at least one active metal oxide is deposited onto the medium pore molecular sieve in an amount greater than 0.1 wt. %, based on the catalyst.

33. The process according to claim 20 wherein said at least one hydrogenation metal is selected from the Group VIII metals.

34. The process according to claim 33 wherein said at least one hydrogenation metal is selected from Pt, Pd and mixtures thereof.

35. The process according to claim 20 wherein said at least one hydrogenation metal is deposited onto the medium pore molecular sieve in an amount ranging from between about 0.1 to about 30 wt. %, based on catalyst.

36. The process according to claim 20 wherein said effective hydrodewaxing conditions include temperatures from 250° C. to 400° C., pressures from 791 to 20786 kPa, liquid hourly space velocities of from 0.1 to 10 $hr^{-1}$, and hydrogen treat gas rates from 45 to 1780 $m^3/m^3$.

* * * * *